US008458926B2

(12) United States Patent
Ewans

(10) Patent No.: US 8,458,926 B2
(45) Date of Patent: Jun. 11, 2013

(54) ROWING SHOES

(76) Inventor: John Frayn Ewans, Buckinghamshire (GB)

( * ) Notice: Subject to any disclaimer, the term of this patent is extended or adjusted under 35 U.S.C. 154(b) by 441 days.

(21) Appl. No.: 12/827,388

(22) Filed: Jun. 30, 2010

(65) Prior Publication Data

US 2010/0325920 A1 Dec. 30, 2010

(30) Foreign Application Priority Data

Jun. 30, 2009 (GB) ..... 0911318.4

(51) Int. Cl.
*A43B 3/26* (2006.01)
*A43B 5/00* (2006.01)

(52) U.S. Cl.
USPC ..... 36/97; 36/114

(58) Field of Classification Search
USPC ..... 36/114, 97; 114/363
See application file for complete search history.

(56) References Cited

U.S. PATENT DOCUMENTS

| | | | | |
|---|---|---|---|---|
| 2,112,052 | A * | 3/1938 | Smith | 36/97 |
| 2,497,175 | A * | 2/1950 | Mantos | 36/97 |
| 3,997,985 | A * | 12/1976 | Shiina | 36/97 |
| 7,055,268 | B2 * | 6/2006 | Ha | 36/97 |
| 7,137,635 | B2 * | 11/2006 | Haugen et al. | 280/11.26 |
| 7,814,605 | B1 * | 10/2010 | Tippel | 15/114 |
| 8,051,794 | B2 * | 11/2011 | Matsueda et al. | 114/363 |
| 2004/0107604 | A1 * | 6/2004 | Ha | 36/97 |
| 2007/0011916 | A1 * | 1/2007 | Olivieri | 36/97 |

FOREIGN PATENT DOCUMENTS

CA 2 591 367 A1 12/2008

OTHER PUBLICATIONS

Combined Search and Examination Report for corresponding Great Britain application.

* cited by examiner

*Primary Examiner* — Marie Patterson
(74) *Attorney, Agent, or Firm* — David & Bujold, PLLC

(57) ABSTRACT

A rowing shoe (1) of adjustable length has a shell (2) divided into heel- and toe-sections (4, 9) carried by parts (6, 7) of an elongate chassis (5). The chassis-part (7) carrying the toe-section (9) slides on a head (21) of chassis-part 6 which is fixed to the foot-stretcher of the boat. A lever (30) pivoted on the chassis-part (7) projects forwardly from the toe-section (9) and has a slotted projection (29) engaged with one of a series of teeth (31) of the head (21) to restrain sliding of chassis-part (7). Depression of lever (30) releases the restraint by lifting projection (29) clear of the teeth (31), so allowing length-adjustment of the shoe (1) to a size indicated through a window (3) on an extension (24) of a plate (23) carried with the chassis-part (7). Release of the lever (30) allows the projection (29) to engage a tooth (31) and hold the adjusted size, urged by pressure of the rower's foot. A wide strap (11) which extends over the instep of the shoe is secured on the outside flank by fabric-fastening (15). The strap (11) covers any gap between heel- and toe-sections (4, 9), and a flap (16) of the heel-section (4) extends under this with its free end towards the inside flank of the shoe to assist along with the strap (11) in lifting the heel-section (4) with the rower's heel during rowing.

15 Claims, 9 Drawing Sheets

ROWING SHOES

This application claims priority from British patent application serial no. 0911318.4 filed Jun. 30, 2009.

FIELD OF THE INVENTION

This invention relates to rowing shoes and is concerned especially with rowing shoes of the kind for attachment to the foot-stretcher of a rowing boat.

SUMMARY OF THE INVENTION

According to one aspect of the present invention there is provided a rowing shoe of a form for fixing to a foot-stretcher of a rowing boat, wherein the shell of the shoe is divided into toe- and heel-sections that are carried by first and second parts respectively of an elongate chassis, the first part of the chassis is slidable on the second part for selectively varying the length of the shoe, the second part includes means for fixing the heel section to the foot-stretcher, a latching mechanism of the chassis is switchable between a restraining state in which sliding movement of the first part of the chassis on the second part is restrained and a release state in which this restraint on sliding movement is released, and a controlling device that is operable manually for selectively switching the latching mechanism from the restraining state to the release state in which adjustment of the length of the shoe is enabled.

The form of shoe according to the invention is of particular advantage for installation in a rowing boat that is to be used by different individuals, in that it enables each individual to adjust the shoes to his/her preference or requirement in shoe-size.

The controlling device may involve a manually-operable lever that extends from the shoe, and in these circumstances actuation of the lever to switch the latching mechanism to the release state may be inhibited by pressure on the lever that results from occupation of the shoe by the rower's foot.

A strap attached to the second part of the chassis may be provided to extend over the instep of the shoe from at least one to the other of the inside and outside flanks of the heel-section. This strap may be wide enough to cover a gap between the heel- and toe-sections of the shell throughout a substantial range of adjustment of the shoe-length.

The chassis may have flexibility to enable the second-part of the chassis carrying the heel-section to rise relative to the front-part with lifting of the rower's heel within it. The lifting of the rower's heels is a movement that desirably accompanies oar-entry during rowing, and it is advantageous that the heel-section should lift at least to a limited degree with this lift to avoid the rower's heel slipping out of the shoe. In accordance with a feature of the present invention the lifting of the heel-section of the shoe with the rower's heel may be brought about by the accompanying upward movement of the instep of the rower's foot on a flap or strap that extends from a first of two opposite flanks of the heel-section across the instep towards the second flank. Such a flap, which may be attached to or integral with the first flank of the heel-section, has the advantage that it can be effective through the upward movement of the rower's instep to lift the heel-section with the rower's heel even though not attached to the second flank (and therefore not restricting freedom of the rower's foot to leave the shoe in an emergency). Where a strap as referred to in the preceding paragraph is used, this may be attached to the second flank and give additional effect in the lifting of the heel-section from the upward movement of the rower's instep. Alternatively, a second flap attached to or integral with the second flank for extending over the instep towards (but not attached to) the first flank, may be used to give the additional lifting effect.

BRIEF DESCRIPTION OF THE DRAWINGS

An example of a form of adjustable-size rowing shoe according to the present invention will now be described with reference to the accompanying drawings, in which.

DETAILED DESCRIPTION OF THE PREFERRED EMBODIMENTS

The rowing shoe shown in the accompanying drawings and to be described is the right-hand shoe of a pair of rowing shoes that are for fixing to the foot-stretcher of a rowing boat. The left-hand shoe is of the same construction as the right-hand shoe, both shoes being selectively adjustable in length to enable them to be adapted to the rower's foot size.

Figure 1:
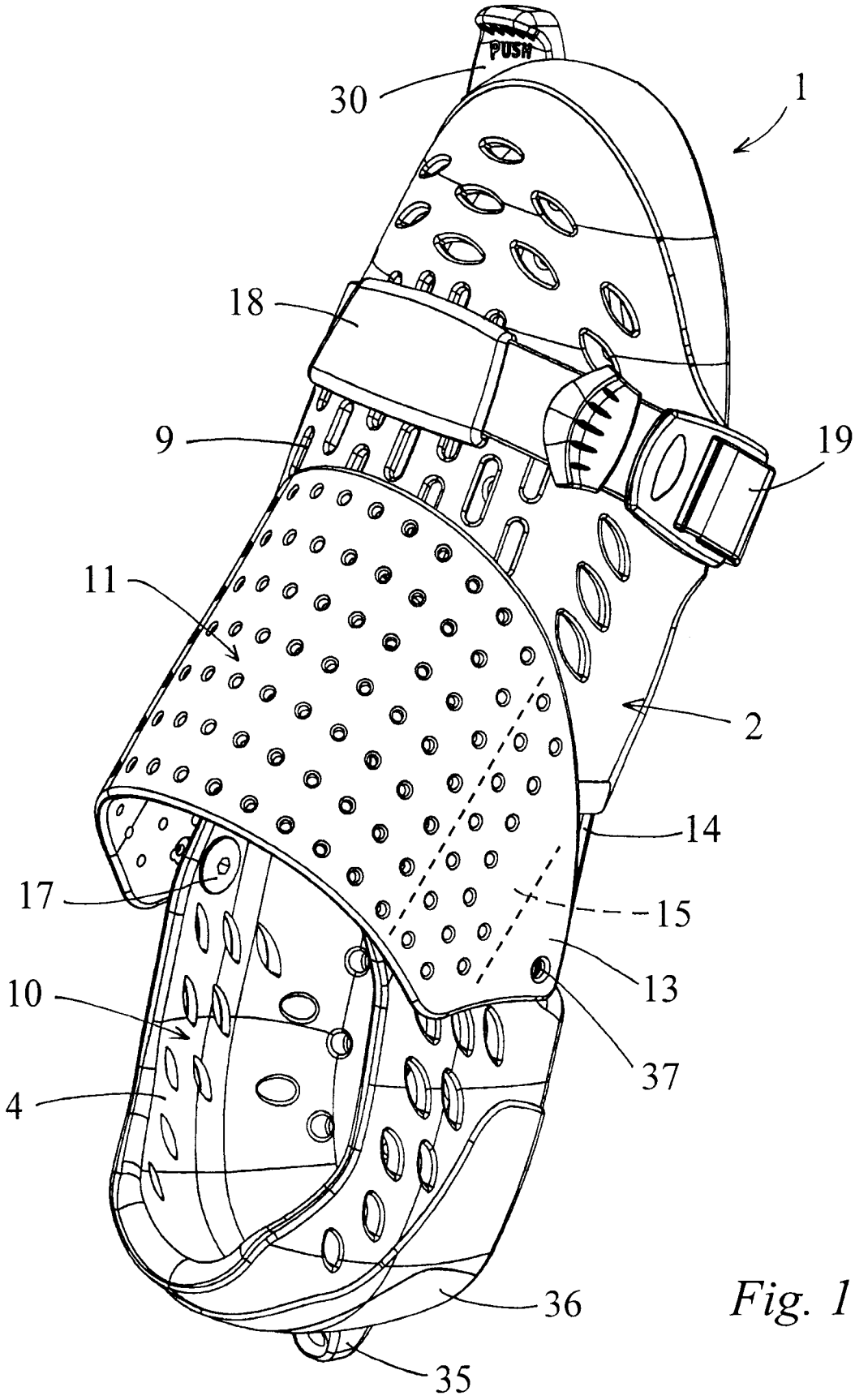
FIGS. 1 to 3 are perspective views from the right, left and rear respectively, of the form of rowing shoe according to the invention.
Figure 2:
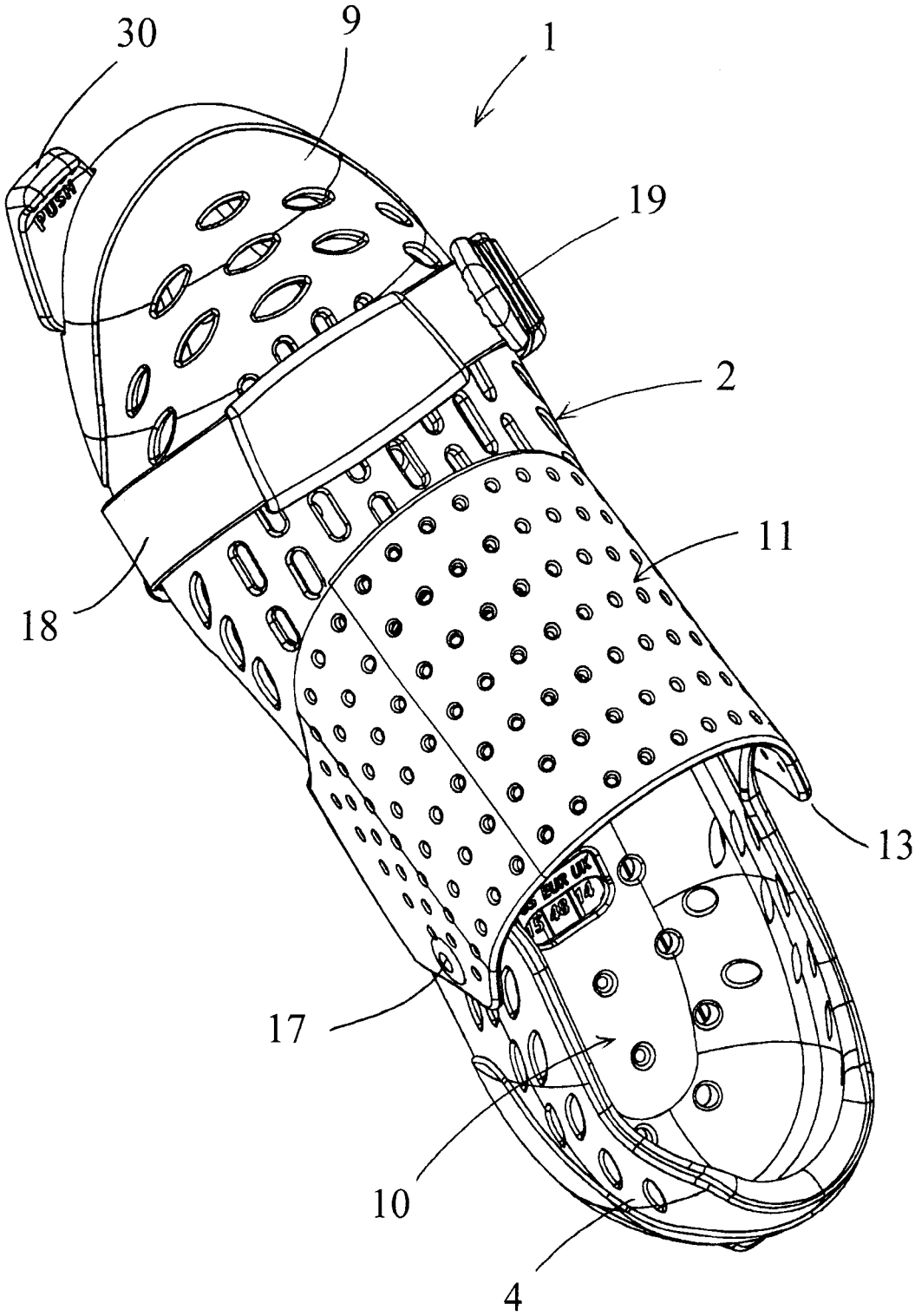
Figure 3:
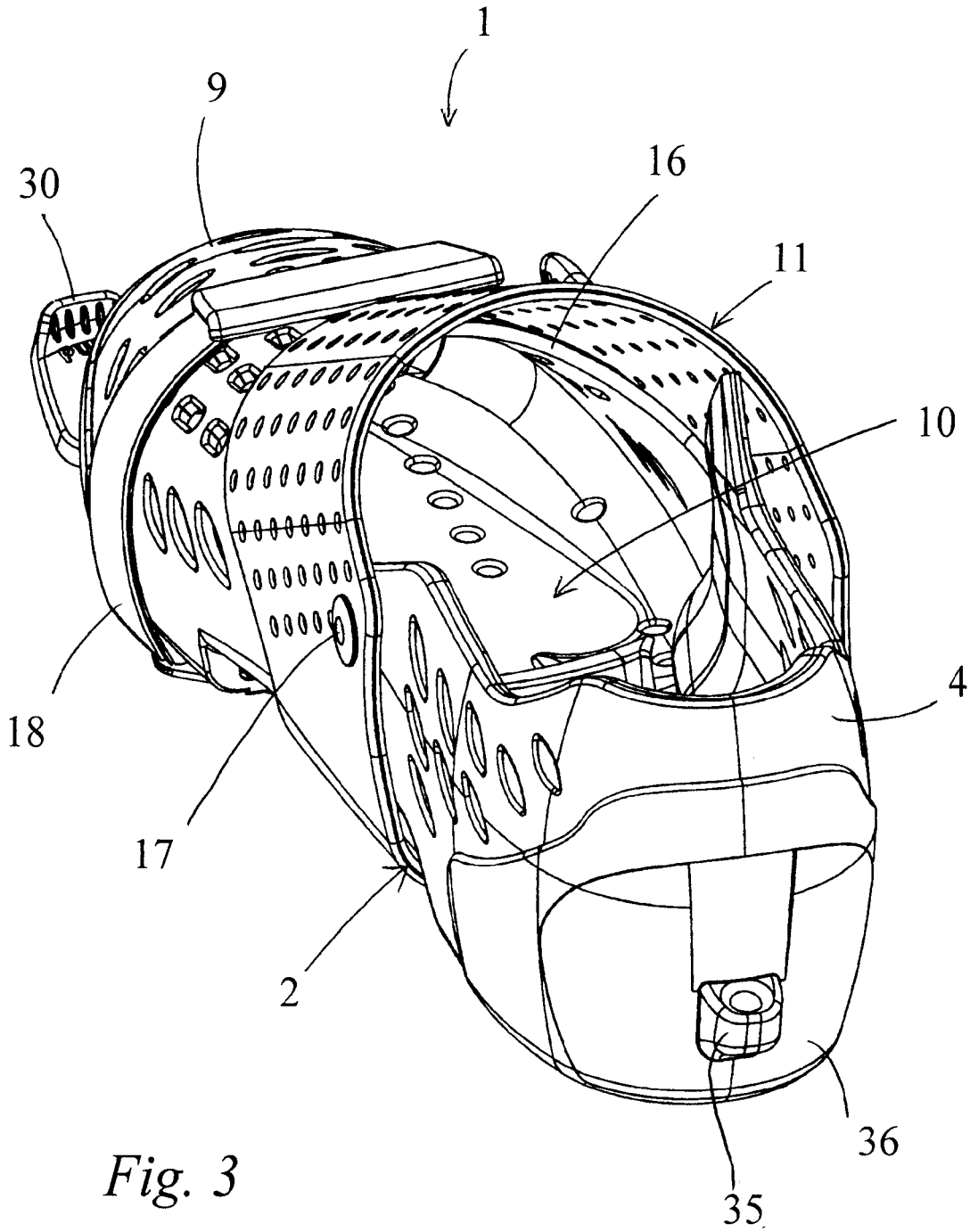
Figure 4:
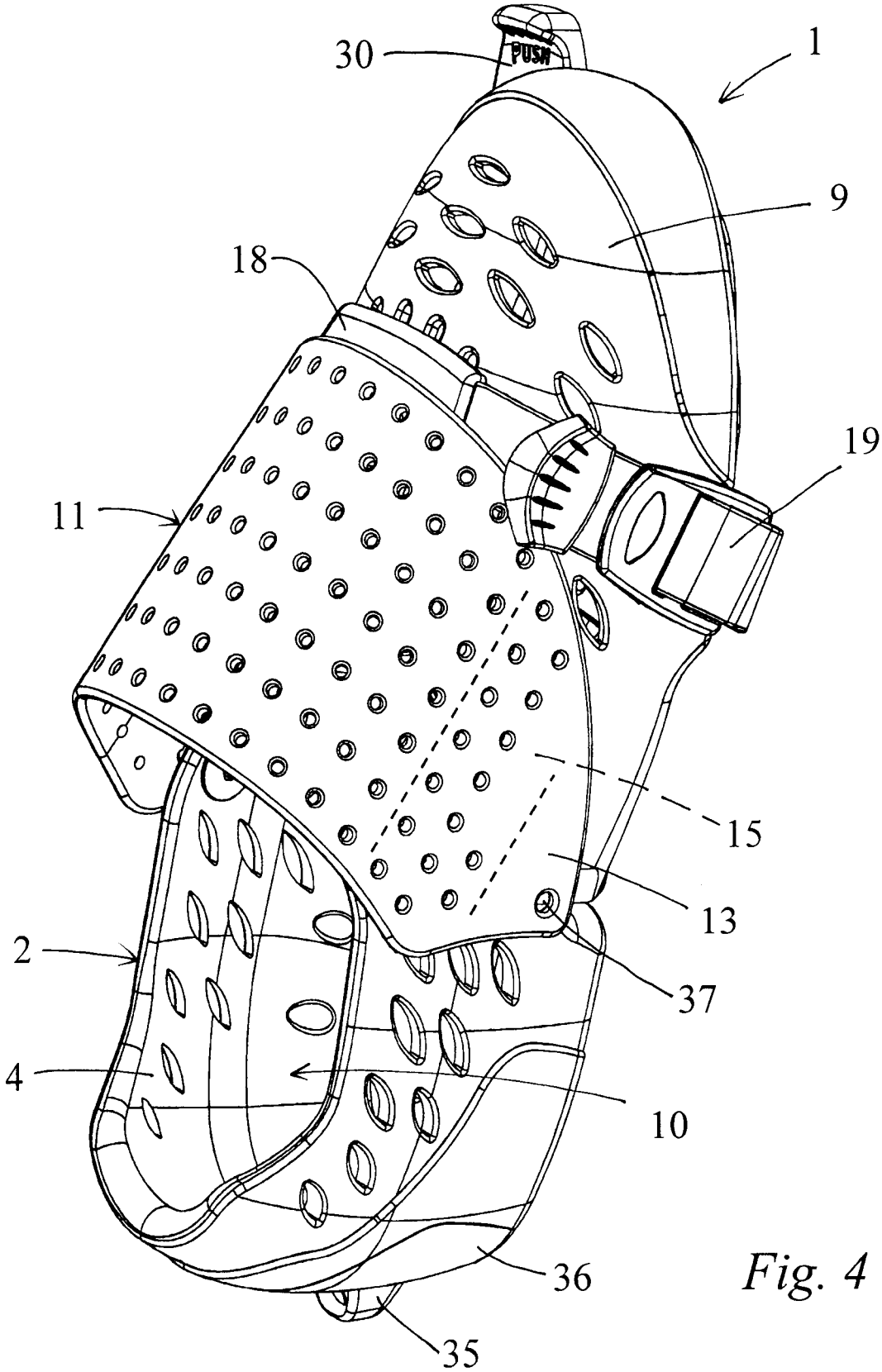
FIG. 4 is a perspective view corresponding to that of FIG. 1 of the rowing shoe of the invention when adjusted for a smaller shoe-size than in FIG. 1.
Figure 5:
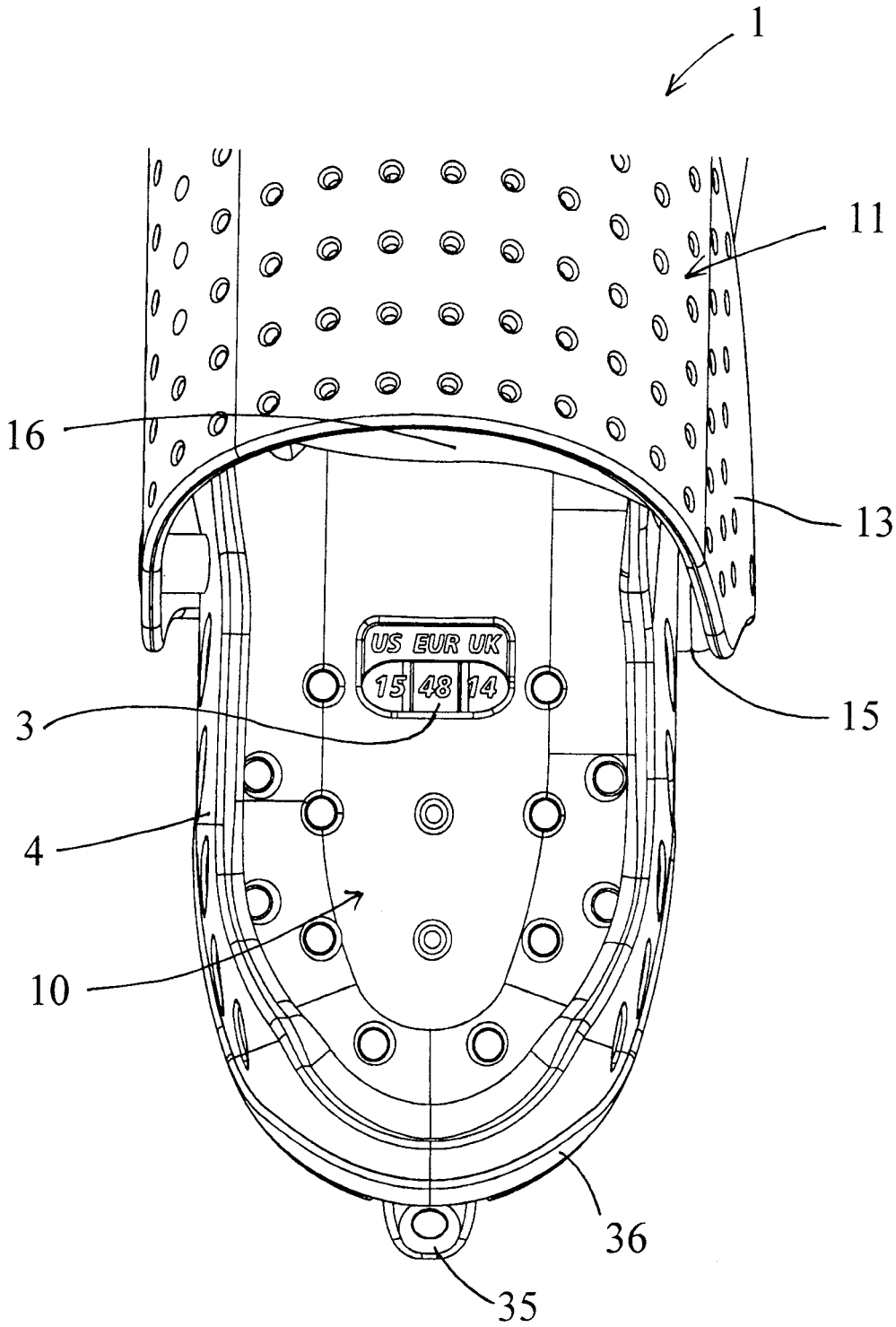
FIG. 5 is a plan view of a heel-section of the form of rowing shoe of the invention, showing a size-indicator within this section of the shoe.

Referring to FIGS. 1 to 4 the rowing shoe 1 illustrated is for receiving and enclosing the rower's right foot, and has a two-part, external shell 2 of a moulded-plastics material (for example, ethylene vinyl acetate copolymer—known as 'EVA'—containing thermoplastic olefin fillers—known as 'TPO'). The shoe 1 is adjustable in length to the size of the rower's foot, and is shown in FIGS. 1 to 3 in an extended condition and in FIG. 4 in a shortened condition. The foot-size to which the shoe 1 is at any time set is revealed (as shown in FIG. 5) in terms of US, European and UK standard sizes within a window 3 in the base of a heel-section 4 of the shell 2.

Figure 6:
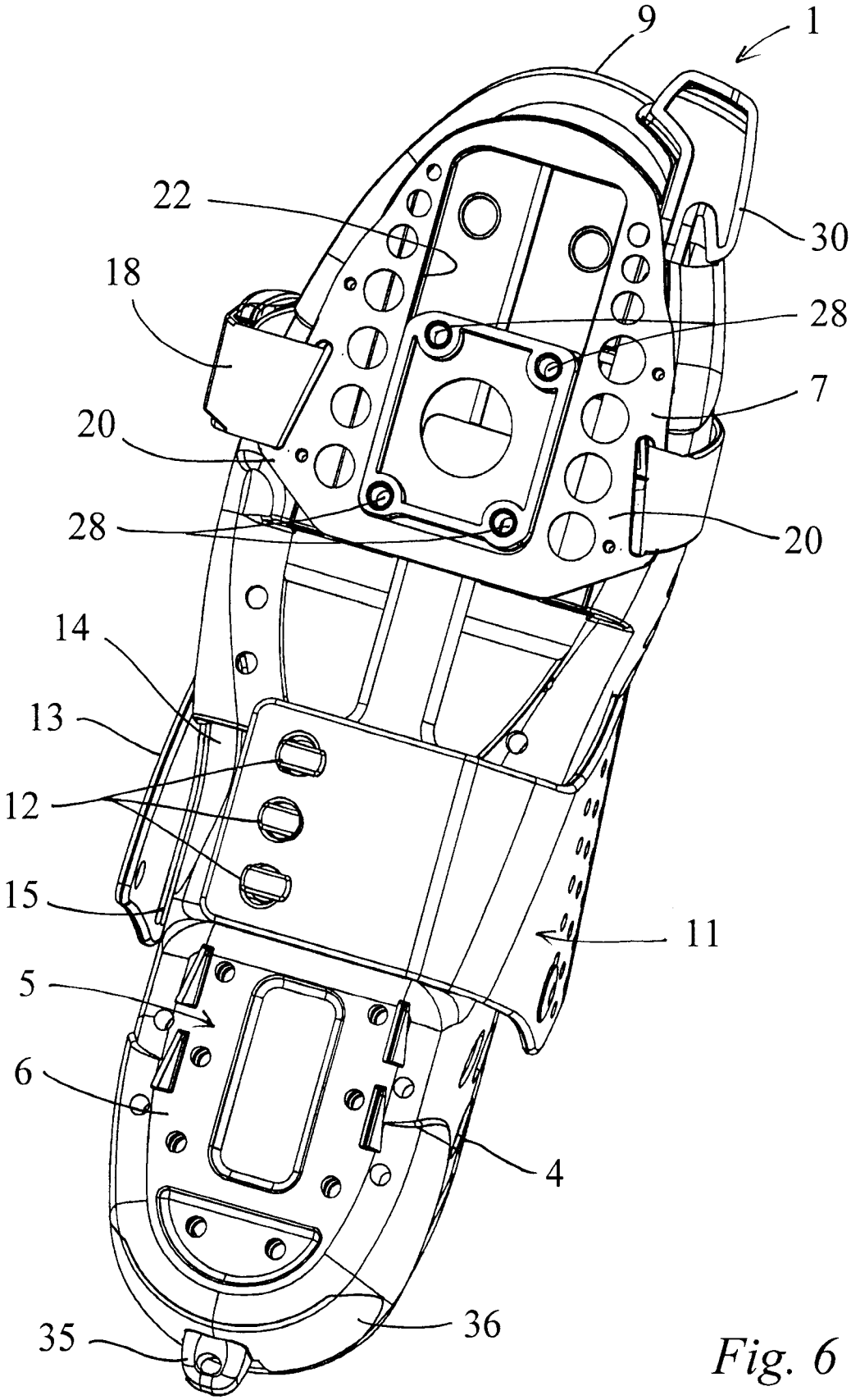
FIG. 6 is an underneath view of the form of rowing shoe of the invention, revealing an adjustable-length chassis of the shoe.
Figure 7:
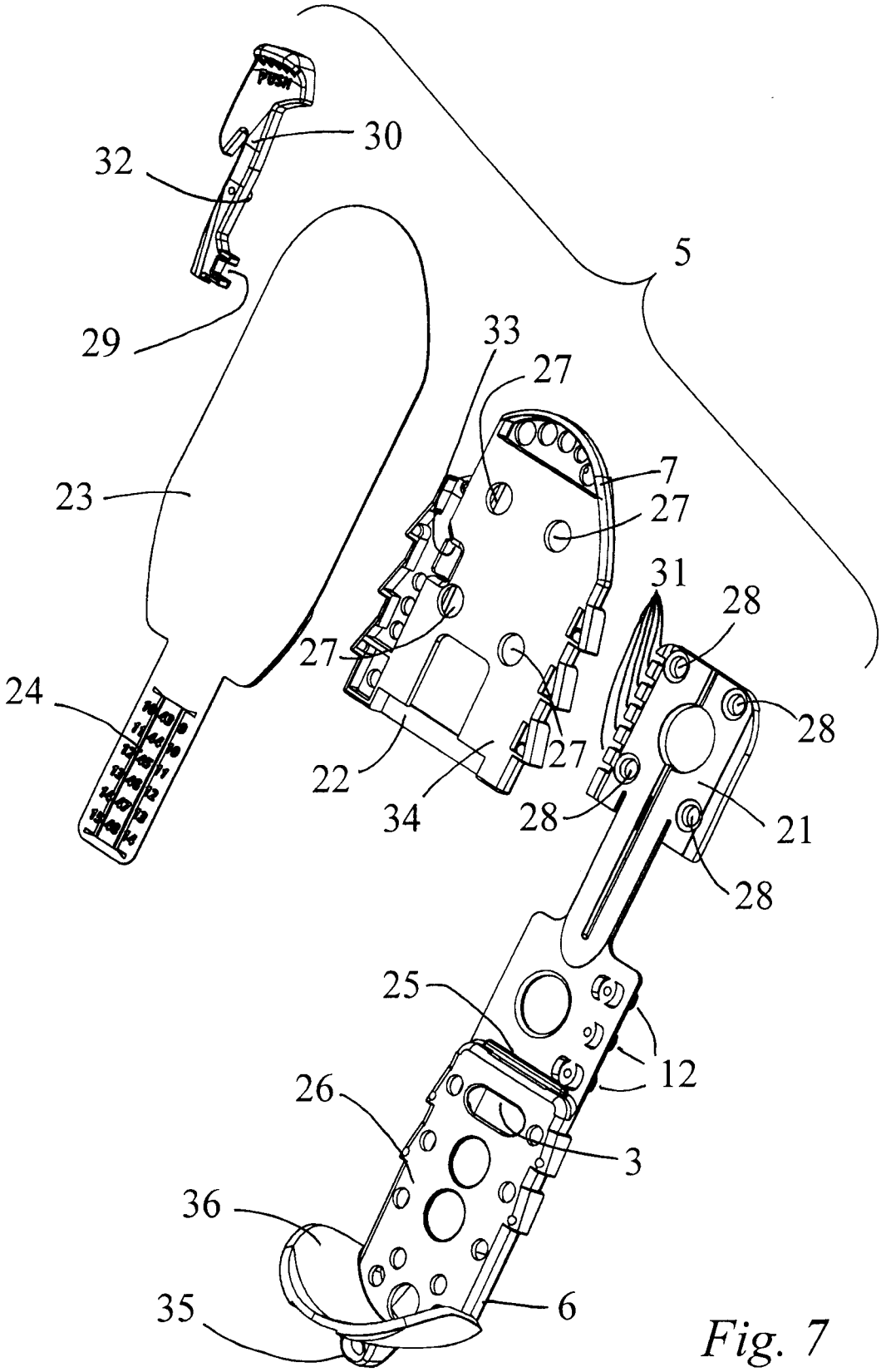
FIG. 7 is an exploded perspective view of components of the adjustable-length chassis of the form of rowing shoe of the invention.

Referring also now to FIGS. 6 and 7, the shell 2 is attached to a chassis 5 which is of a firmly-flexible plastics material and which is in two parts 6 and 7 that interlink with one another to form an effective external-sole of the shoe 1. The part 6, which provides an effective spine of the chassis 5 extending almost the full length of the shoe 1, has the heel-section 4 of the shell 2 attached to it, whereas a separate toe-section 9 of the shell 2 is attached to the part 7 to the front of the chassis 5. The heel- and toe-sections 4 and 9 of the shell 2 together form an insole 10 of the shoe 1 by overlap of the base of section 4 with the base of section 9. The heel-section 4 extends sufficiently towards the toe of the shoe 1 to maintain the overlap throughout the full range of length-adjustment (adjustment of size) of the shoe 1.

The gap that occurs between the sections 4 and 9 at the sides and around the instep of the shoe 1, more especially when the shoe 1 is extended in length, is covered by a wide, moulded-plastics strap 11. The strap 11 is secured at one end to lugs 12 on the underside of the part 6 of the chassis 5. From the lugs 12 the strap 11 extends across the underside of the chassis 5 to the inside flank of the shoe 1 and then up and over the instep of the shoe 1 for attachment at its free end 13 on the outside flank of the shoe 1 to a plastics tongue 14 secured to the lugs 12. The attachment of strap 11 to the tongue 14 is by means of a selectively-releasable fabric-fastening 15 (such as sold under the Registered trade Mark VELCRO).

A flap 16 (see FIGS. 3 and 5) formed integrally with the heel-section 4 on the outside flank of the shoe 1, extends under the strap 11 across the top of heel-section 4 towards (but is not attached to) the inside flank of the shoe 1. The strap 11 on the other hand is attached to the heel-section 4 on the inside flank of the shoe 1 by a stud 17 (FIGS. 1 tom 3), so that the strap 11 and the flap 16 under it, extend in opposite directions across the instep of the shoe 1 from opposite flanks of the heel-section 4.

A two-part strap 18 with adjustable-buckle 19 is attached at its two ends to a plate 20 screwed to the underside of the front-part 7 of the chassis 5 (see FIG. 6). The buckle 19 enables the front-section 9 of the shell 2 to be adapted for comfort to the width of the rower's foot so that together with adjustment of length of the shoe 1 a good fit of the shoe 1 (and in a corresponding way, of the left shoe) is obtainable for comfort and rowing-efficiency.

Figure 8:
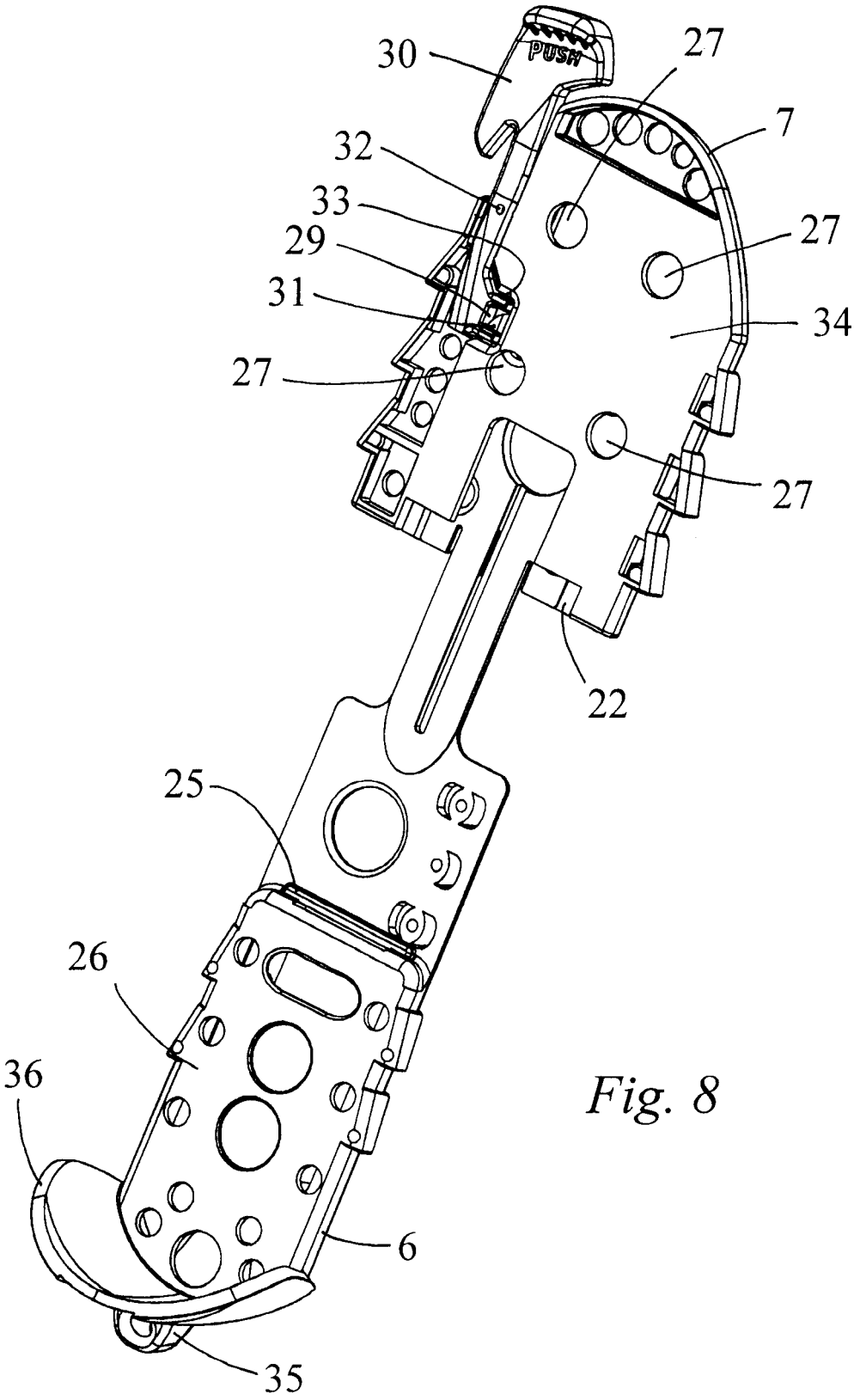
FIGS. 8 and 9 are top and bottom views respectively of the assembled chassis of FIG. 7.
Figure 9:
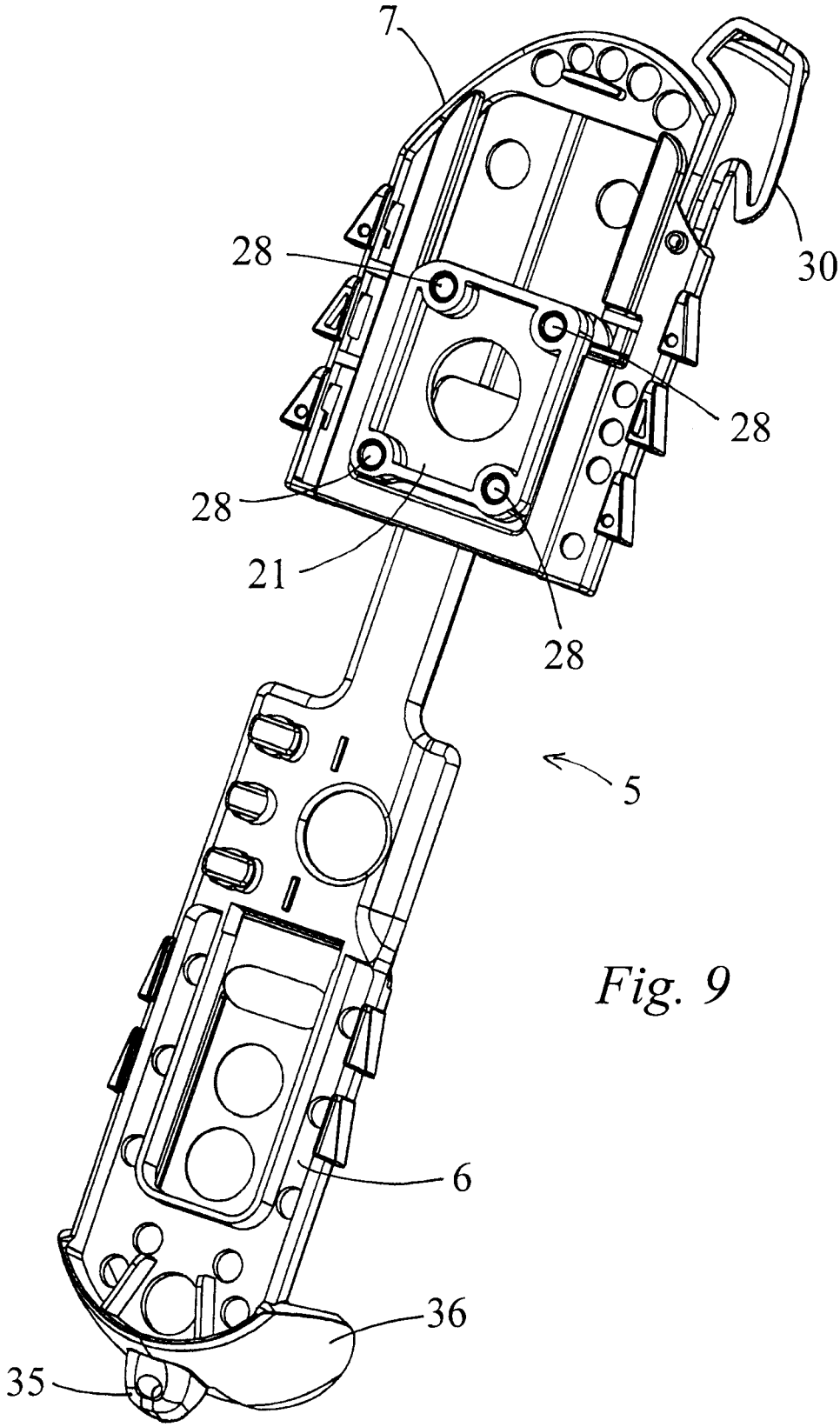

Referring more particularly to FIGS. 7 to 9, the front-part 7 of the chassis 5 is slidably-mounted on a latching head 21 of the spine-part 6 with the head 21 engaged within a slide 22 of the part 7. Sliding of the part 7 along the head 21 varies the length of the assembled chassis 5 and therefore the shoe-size. More particularly, a plate 23 of plastics which has a rearward extension 24 inscribed with the ranges of US, European and UK shoe-sizes covered by the shoe, overlies the part 7 with the extension 24 projecting into a slot 25 under an upper, heel platform 26 of the part 6. The plate 23 is secured to the head 21 by lugs (not shown) that are engaged in holes 27 of the part 7, so as to move with the part 7 relative to the head 21 and according to the overall length of the chassis 5 reveal the relevant inscriptions of shoe-size in the window 3 visible through the insole 10 (FIG. 5).

Chassis-part 6 of the shoe 1 is secured fast to the foot-stretcher (not shown) of the rowing boat by screw- or bolt-fixings (not shown) through eyes 28 of the latching head 21. Accordingly, heel-section 4 of the shell 2 is retained fixed to the foot-stretcher, and it is the projection of the front-part 7 of the chassis 5 with its attached toe-section 9 that varies in dependence of the shoe-size set.

The setting of size of the shoe 1 in length is made by engagement of a slotted projection 29 of a latching lever 30 that extends from the front of the shoe 1, with respective ones of a series of six latching teeth 31 of the head 21. The lever 30 is mounted under the plate 23 on a pivot 32 of the part 7 for pivotal movement through an aperture 33 in the top surface 34 of the part 7 such that while the lever 30 is not depressed one or other of the teeth 31 of the head 21 is engaged in the slot of the projection 29. The particular tooth 31 engaged depends on the relative locations of the head 21 and part 7, and therefore on the set-size of the shoe 1.

Release of the engagement of the tooth 31 by the projection 29 to enable adjustment of the size of the shoe 1 is made by depressing the lever 30 where it projects from the front of the shoe 1. Depression of the lever 30 in this way, pivots it about the pivot 32 to lift the projection 29 upwardly through an aperture 33 in the upper surface 34 of the part 7 to disengage it from the engaged tooth 31. While the lever 30 continues to be depressed therefore, the front-part 7 of the chassis 5 carrying the toe-section 9 may be slid relative to the rear-part 6 carrying the heel-section 4 to increase or decrease the length of the shoe 1. Once the required shoe-size is indicated in the window 3, release of the lever 30 allows the projection 29 to pivot downwardly within the aperture 33 to engage the underlying tooth 31 individual to that size. To a limited extent, the natural resilience of the moulded-plastics material of the toe-section 9 of the shell 2 tends to return the lever 30 to engagement of the projection 29 with the teeth 31, but positive action in this respect and maintaining the engagement is provided by pressure of the rower's foot within the shoe 1. This ensures that the shoe 1 is held firmly to the set size during rowing.

The material and construction of the chassis 5 allows for bending of the shoe 1 from heel to toe, in particular it allows for rise of the rower's heel for good oar-entry during rowing. The rower's movement which brings about the lifting of his/her heel is accompanied by an upward movement of the instep of the rower's foot. This upward movement against the underside of the flap 16 of the heel-section 4, together with the accompanying upward pressure on the underside of the strap 11 attached to the heel-section 14 via the stud 17, raises the heel-section 4 along with the rower's heel. However, the extent of rise of the heel-section 4 of the shoe 1 is normally to be limited by a tie-down (not shown) to the boat and provision for attachment of the tie-down to the shoe 1 is made by an eye 35 that projects from a heel-guard or -counter 36 of the rear-part 6 of the chassis 5.

Limitation of the extent by which the heel-section 4 can be raised ensures that the rower by continuing to lift his/her heel can extract it from the heel-section 4 and thereby be able to slip his/her foot free from the shoe 1 in the event of a capsize or other emergency. Release of the foot from the shoe 1 can also be enabled in both emergency and normal circumstances by releasing the fabric-fastening 15. An eye 37 (FIGS. 1 and 4) in the free end 13 of the wide-strap 11 is provided near the fastening 15 for attachment of a cord (not shown) that is looped across the shoe 1 for attachment to the corresponding eye of the left shoe, so that pulling on the loop frees in the one action, the rower's feet for withdrawal from both shoes.

The invention claimed is:

1. A rowing shoe of adjustable length for fixing to a foot-stretcher of a rowing boat, the shoe comprising:

(a) a shell of the shoe, the shell comprising a toe-section and a heel-section; and (b) a chassis for carrying the shell, the chassis comprising a first chassis-part carrying the toe-section of the shell and a second chassis-part carrying the heel-section of the shell, the first chassis-part being slidable on the second chassis-part for selectively varying the length of the shoe, and the second chassis-part including means for fixing the heel-section to the foot-stretcher of the boat, and wherein the chassis further includes a latching mechanism that is switchable between a restraining state in which the latching mechanism applies a restraint against sliding movement of the first chassis-part on the second chassis-part, and a release state in which the restraint on the sliding movement of the first chassis-part is released, and a controlling device that is operable manually for selectively switching the latching mechanism from the restraining state to the release state to enable the length of the shoe to be adjusted.

2. The rowing shoe according to claim 1, wherein the controlling device is a manually-operable lever that extends from the toe-section of the shoe.

3. The rowing shoe according to claim 1, wherein the latching mechanism includes first and second elements carried by the first and second chassis-parts respectively, the first and second elements engaging with one another to block sliding movement of the first chassis-part on the second chassis-part in the restraining state of the latching mechanism, and wherein manual operation of the controlling device disengages the first and second chassis-elements from one another by pivoting the first and second elements apart from one another into the release state of the latching mechanism.

4. The rowing shoe according to claim 3, wherein engagement of the first and second elements with one another is between a tooth defined in one of the first and second elements and a slot defined in the other of the first and second elements.

5. The rowing shoe according to claim 4, wherein the tooth is a tooth dependent on the length of the shoe of a series of teeth of the second element, and the slot is defined in the first element.

6. The rowing shoe according to claim 5, wherein the controlling device is a lever pivoted to the first chassis-part, the lever carries the first element for pivotal movement of the slot defined in the first element out of engagement with the tooth of the series of teeth.

7. The rowing shoe according to claim 1, including a gap-covering strap for covering gap between the toe- and heel-sections throughout a range of length-adjustment of the shoe, wherein the gap-covering strap is secured to the second chassis-part of the chassis.

8. The rowing shoe according to claim 7, wherein the gap-covering strap extends over an instep of the shoe, and a selectively-releasable fabric-fastening located at one of two opposite flanks of the heel-section is operative to retain the gap-covering strap extended over the instep of the shoe.

9. The rowing shoe according to claim 7, wherein the gap-covering strap is secured by a stud fixing to an inside flank of the heel-section.

10. The rowing shoe according to claim 7, including an instep-bridging flap for extending over an instep of a rower's foot entered in the shoe, the instep-bridging flap having a free end and extending under the gap-covering strap from a first of first and second opposite flanks of the heel-section to locate the free end towards the second flank.

11. The rowing shoe according to claim 10, wherein the gap-covering strap extends over the instep of the shoe from an inside flank of the heel-section to means for selectively-releasable attachment of the gap-covering strap at an outside flank of the heel-section, and the instep-bridging flap extends from the outside flank of the heel-section to locate the free end of the instep-bridging flap towards the inside flank.

12. The rowing shoe according to claim 1, including an instep-bridging flap for extending over an instep of a rower's foot entered in the shoe, the instep-bridging flap having a free end and extending from a first of first and second opposite flanks of the heel-section to locate the free end towards the second flank.

13. The rowing shoe according to claim 1, wherein the chassis has flexibility to enable the heel-section to lift with lifting of a heel of a rower's foot entered in the heel-section.

14. The rowing shoe according to claim 1, wherein the heel- and toe-sections of the shoe together form an insole of the shoe.

15. The rowing shoe according to claim 14, wherein a base of the heel-section overlaps a base of the toe-section throughout a range of length-adjustment of the shoe.

* * * * *